US006931903B2

(12) United States Patent
Knudson et al.

(10) Patent No.: US 6,931,903 B2
(45) Date of Patent: Aug. 23, 2005

(54) APPARATUS AND METHOD FOR ROLL FORMING SHAPED MEMBERS

(76) Inventors: Gary A. Knudson, 79485 Cetrino, La Quinta, CA (US) 92253; Patrick D. Flood, 269 West Dr., Golden, CO (US) 80403

( * ) Notice: Subject to any disclaimer, the term of this patent is extended or adjusted under 35 U.S.C. 154(b) by 71 days.

(21) Appl. No.: 10/184,680

(22) Filed: Jun. 28, 2002

(65) Prior Publication Data

US 2004/0000181 A1 Jan. 1, 2004

(51) Int. Cl.[7] ..... B21D 5/08
(52) U.S. Cl. ..... 72/181
(58) Field of Search ..... 72/176, 181, 226

(56) References Cited

U.S. PATENT DOCUMENTS 1,184,947 A * 5/1916 Gossett ..... 72/52
2,150,731 A * 3/1939 Smith ..... 72/168
2,248,088 A * 7/1941 Kane ..... 72/162
2,561,634 A * 7/1951 Picton ..... 72/181
3,529,461 A * 9/1970 Knudson ..... 72/181
3,777,531 A * 12/1973 McClain ..... 72/181
4,724,695 A * 2/1988 Stoehr ..... 72/181
4,787,233 A * 11/1988 Beymer ..... 72/181
4,899,566 A 2/1990 Knudson
5,187,964 A * 2/1993 Levy ..... 72/181

* cited by examiner

*Primary Examiner*—Daniel C. Crane
(74) *Attorney, Agent, or Firm*—Ancel W. Lewis, Jr.

(57) ABSTRACT

Apparatus for roll forming shaped members from sheet material has a primary powered section that roll forms along a primary pass line and a secondary powered section. The secondary powered section is coupled to and powered by the primary powered section, and roll forms along a secondary pass line that is separate from the primary pass line. The secondary powered section is coupled to the primary powered section by a transmission that allows adjustment of the secondary pass line in translation in two directions and in rotation in two directions. The method of roll forming includes forming shaped members in sections with the apparatus.

21 Claims, 4 Drawing Sheets

APPARATUS AND METHOD FOR ROLL FORMING SHAPED MEMBERS

TECHNICAL FIELD

The present invention relates sheet metal roll forming and more particularly to a method and apparatus for forming shaped members from a strip of malleable material with commonly powered sections having two different pass lines.

BACKGROUND ART

In roll forming apparatus, a flat sheet of malleable material, such as sheet metal, enters the apparatus at the entry end, is formed by a plurality of rollers, and exits the apparatus as a shaped member at the discharge end. A portion of the material passes through the apparatus without any forming. For example, in apparatus for forming a rain gutter with a trough having a flat bottom, generally the trough bottom at any point along the length of the apparatus is parallel to the flat sheet at the entry end and passes through the apparatus without being formed. The path along which the material passes without being formed is a surface called the pass line.

The pass line is defined by the forming rollers. The pass line extends longitudinally in the direction that material travels through the roll forming apparatus and laterally parallel to the axis of the rollers. The pass line may be a planar or may be a curved surface. U.S. Pat. No. 3,529,461 to Knudson discloses a pass line that follows a parabolic section along the length of the roll forming apparatus.

In prior known roll forming applications, powered drive rollers and powered forming rollers apply power at the material pass line. Powered forming rollers have contours to form or shape material with diameters that vary from the nominal pass line diameter. Generally, the nominal throughput speed of the roll forming apparatus is a function of drive roller rotational speed and diameter at the pass line. The actual linear speeds of the rollers vary where they contact the material due to changes in diameter away from pass line.

Forming that takes place above or below the pass line is often accomplished using idled forming rollers rather than powered forming rollers to avoid the speed variations that occur in powered forming rollers as diameters vary away from nominal pass line. However, forming away from the pass line without power also induces a great deal of drag on the profile. This drag typically leads to profile distortion and unbalanced residual forces in the finished profile.

In other prior known roll forming apparatus the forming of complex shapes is performed at or near the pass line. U.S. Pat. No. 4,899,566 to Knudson discloses apparatus to form ogee type rain gutter. The multiple variations from the pass line of each set of rollers for such apparatus must be accounted for in the roller design to prevent distortion and residual stress and the design is therefore complex.

Errors in the design of such complex rollers can create residual stress in the product, leading to warped output from the roll forming apparatus. Often such errors can only be corrected by fabricating and installing new rollers.

DISCLOSURE OF THE INVENTION

Apparatus for roll forming shaped members includes a roll forming primary powered section with a primary pass line and a roll forming secondary powered section with a secondary pass line separate from the primary pass line. The secondary powered section is coupled to the primary powered section by a gear based transmission that provides consistent gear mesh while allowing adjustment of the secondary pass line relative to the primary pass line in two directions and about two rotational axis. The method includes roll forming a first shape with a primary powered section having a primary pass line and then roll forming a second shape with a secondary powered section having a secondary pass line. The secondary powered section eliminates the drag, profile distortion and unbalanced residual forces created by idled forming rollers out of the primary pass line. Forming shaped members in multiple sections reduces the complexity and cost of the design and fabrication of the forming rollers. The adjustability of the secondary powered section allows warp and residual stress to be eliminated in the final shaped member.

BRIEF DESCRIPTION OF THE DRAWINGS

Details of this invention are described in connection with the accompanying drawings which like parts bear similar reference numerals in which.

DETAILED DESCRIPTION

Figure 1:
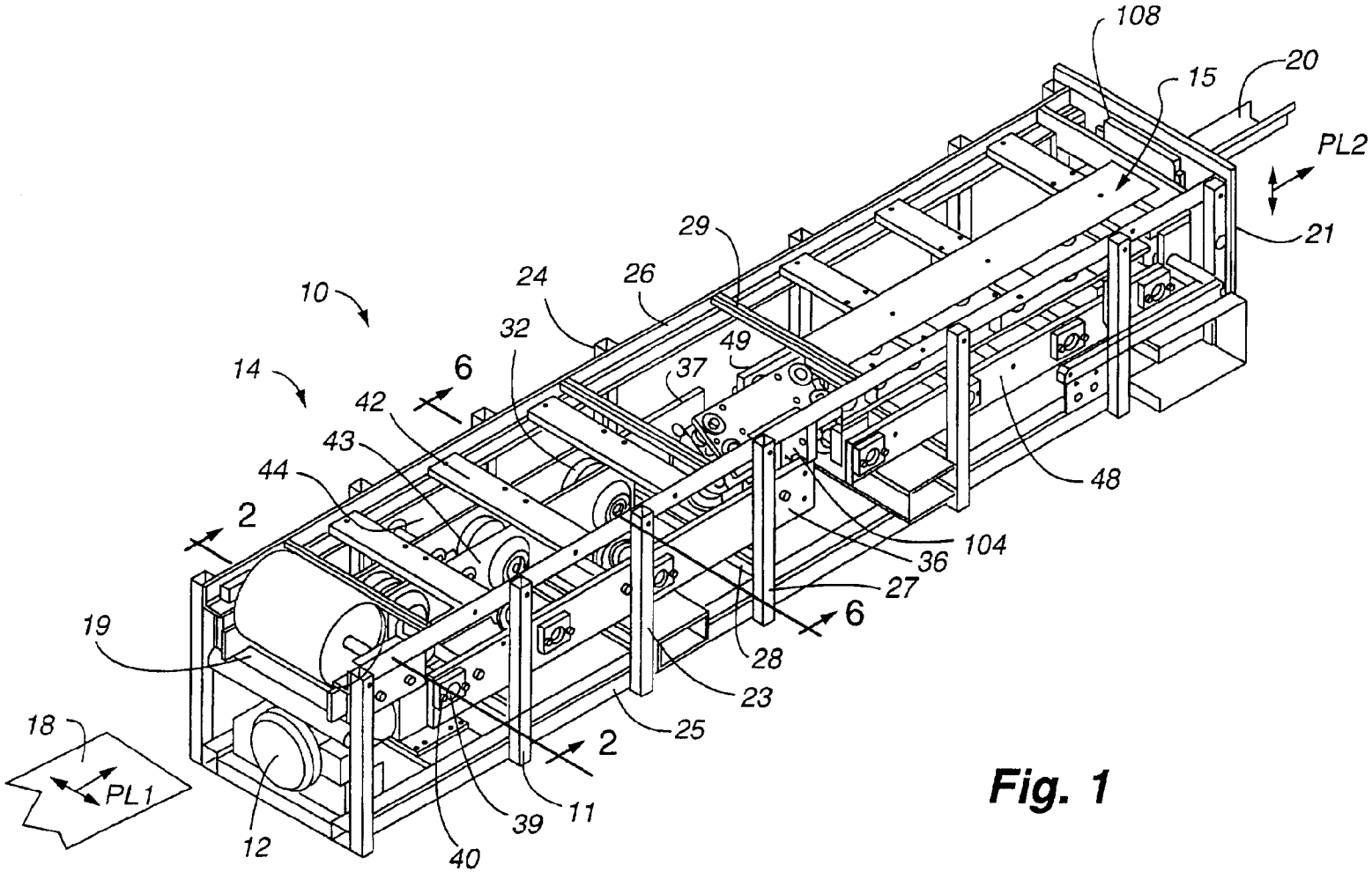
FIG. 1 is a perspective view of roll forming apparatus embodying features of the present invention.

Referring now to FIG. 1, apparatus 10 for roll forming shaped members from a strip of sheet material embodying features of the present invention includes a frame 11, a motor 12, a roll forming primary powered section 14 and a roll forming secondary powered section 15. A generally flat sheet of malleable material 18, preferably sheet metal, enters apparatus 10 at the entry end 19, is formed by the primary and secondary powered sections 14 and 15, and in the illustrated embodiment, a formed gutter 20 exits apparatus 10 at the discharge end 21.

Describing the specific embodiments herein chosen for illustrating the invention, certain terminology is used which will be recognized as being employed for convenience and having no limiting significance. For example, the terms "vertical", "horizontal, "lateral", "longitudinal", "upper" and "lower" refer to the illustrated embodiment in its normal position of use. Further, all of the terminology above-defined includes derivatives of the word specifically mentioned and words of similar import.

The frame 11 has laterally spaced, opposed, generally vertical first and second sides 23 and 24, each having a generally rectangular shape and extending longitudinally from the entry end 19 to the discharge end 21. Each of the first and second sides 23 and 24 has a lower member 25, an upper member 26 spaced in a parallel relationship above the lower member 25, and a plurality of spaced upright members 27 rigidly connected between the lower member 25 and the upper member 26. A plurality of spaced lower cross members 28 rigidly connect between the lower members 25 of the first and second sides 23 and 24. A plurality of spaced upper cross members 29 rigidly connect between the upper members 26 of the first and second sides 23 and 24. In the illustrated embodiment, the lower members 25, upright members 27, lower cross members 28 and upper cross members are made from square steel box tubing and the upper members 26 are steel angle iron.

Figure 2:
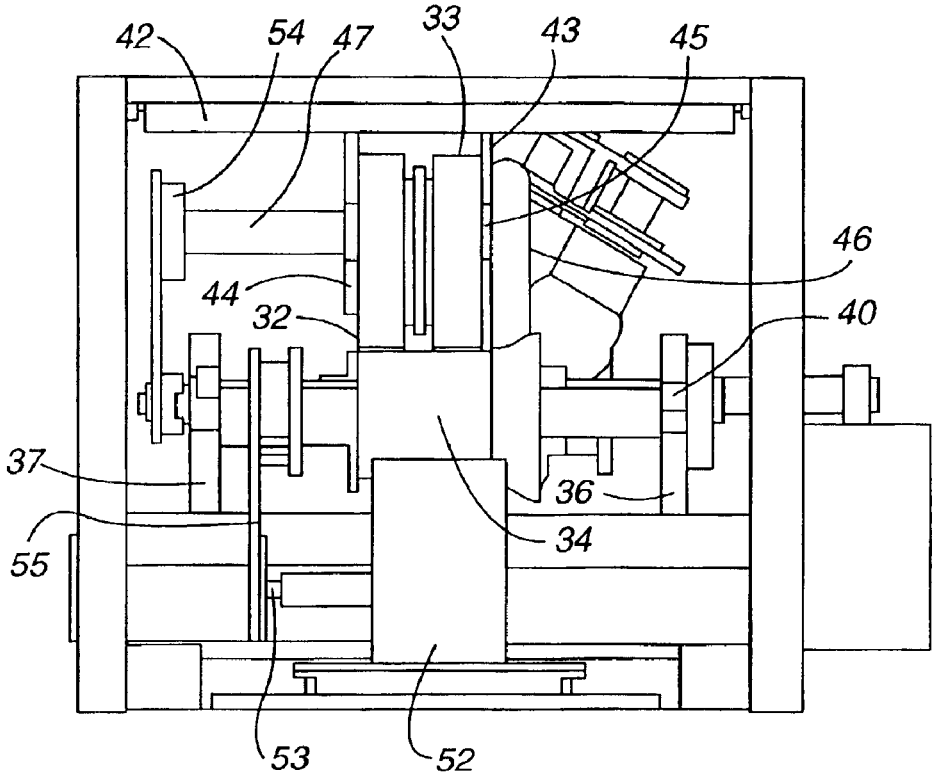
FIG. 2 is a sectional view taken along line 2—2 of FIG. 1.

The primary powered section and secondary powered section 14 and 15 are spaced consecutively along the longitudinal extent of the frame 11, with the primary powered section 14 nearer the entry end 19. Referring to FIGS. 1 and 2, the primary powered section 14 includes spaced roll forming primary stations 32, each having upper and lower primary rollers 33 and 34. Longitudinally extending, vertical, spaced, opposed first and second side plates 36 and 37 mount on the lower cross members 28 between the first and second sides 23 and 24 of the frame 11. The lower primary rollers 34 are each mounted on a powered lower primary shaft 39. Lower primary shaft bearings 40 are mounted in a longitudinally spaced relationship in the first and second side plates 36 and 37, with the lower primary shafts 39 rotably mounted between the first and second side plates 36 and 37 in the lower primary shaft bearings 40.

A plurality of longitudinally spaced, horizontal primary cross plates 42 extend between the upper members 26 of the first and second sides. Longitudinally extending, vertical, spaced first and second primary hanging plates 43 and 44 depend downward from the primary cross plates 42, parallel to and intermediate the first and second sides 23 and 24. Spaced upper primary shaft bearings 45 are mounted in the first and second primary hanging plates 43 and 44 with upper primary shafts 46 rotably mounted in the upper primary shaft bearings 45 and the upper primary rollers 33 mounted on the upper primary shafts 46 over the lower primary rollers 34. Upper drive shaft 47 is rotably mounted in the first and second primary hanging plates 43 and 44 between two of the upper primary shafts 46.

Figure 3:
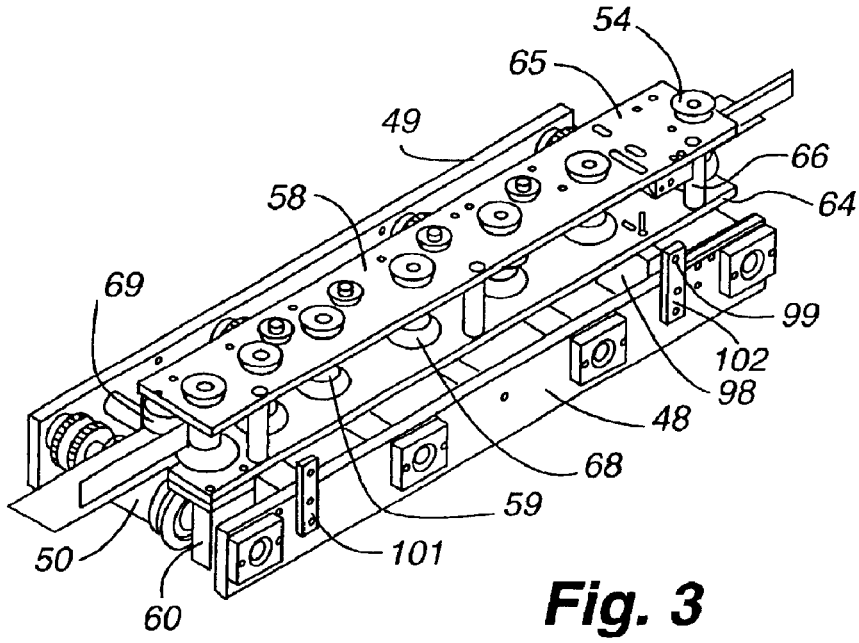
FIG. 3 is a perspective view of the secondary powered section of the apparatus of FIG. 1.

As shown in FIGS. 1 and 3, longitudinally extending, vertical, spaced, opposed third and fourth side plates 48 and 49 mount on the lower cross members 28 between the first and second sides 23 and 24 of the frame 11, between the first and second side plate 36 and 37, and the discharge end 21. A plurality of drive rollers 50 are each mounted on lower primary shafts 39. The lower primary shafts 39 are rotably mounted in lower primary shaft bearings 40, which are mounted in the third and fourth side plates 53 and 54.

Referring again to FIGS. 1 and 2, in the illustrated embodiment, the motor 12 mounts on the frame 11 near the entry end 19, below the primary powered section 14. The motor 12 includes a right angle drive 52 with an output shaft 53 having a laterally extending axis of rotation. A chain sprocket 54 is mounted on the output shaft 53, and at least one chain sprocket 54 is mounted on each of the lower and upper primary shafts 39 and 46, and the drive shaft 47. Endless chains 55 are trained around pairs of sprockets 54, to transmit power from the output shaft 53 to all of the lower primary shafts 39, to the drive shaft 47 and to the upper primary shafts 46. Other means for transmitting power from the output shaft 53 to all of the lower and upper primary shafts 39 and 46 are suitable, such as gears or endless belts.

The primary pass line PL1 is defined by the upper and lower primary rollers 33 and 34. The primary pass line PL1 is a generally horizontal surface that extends the length of apparatus 10 and laterally parallel to and intermediate the lower and upper primary shafts 39 and 46. In the illustrated embodiment, in which a rain gutter having a trough with a flat bottom is formed, the trough is formed by the primary powered section 14 and the trough bottom passes unformed along the primary pass line PL1. The powered drive rollers 50 drive the material 18 along the primary pass line PL1.

As shown in FIG. 3, the secondary powered section 15 includes a subframe 58, a plurality of roll forming secondary stations 59 and a transmission 60. The subframe 58 extends longitudinally above the drive rollers 50 and has a generally horizontal lower plate 64, a generally horizontal upper plate 65 spaced above the lower plate 64, and a plurality of upright connecting rods 66 connected between lower and upper plates 64 and 65. The secondary stations 59 each have first and second secondary rollers 68 and 69. Each of the first secondary rollers 68 is mounted on a powered forming secondary shaft 70. Each of the second secondary rollers 69 is rotably mounted between the lower and upper plates 64 and 65, with the secondary shafts 70 extending substantially vertically therebetween. One or more chain sprockets 54 are mounted on each secondary shaft 70, and chains 55 (not shown in FIG. 3) are trained around the chain sprockets 54 for transmission of power between the secondary shafts 70.

Figure 4:
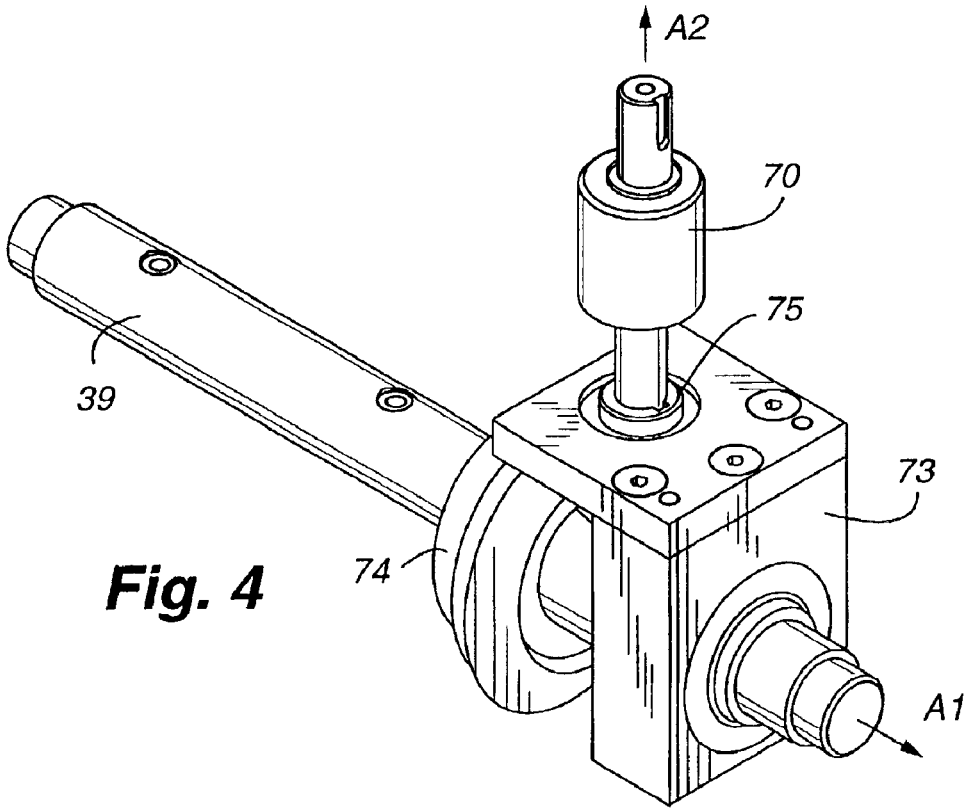
FIG. 4 is a perspective view of the transmission of the secondary powered section of FIG. 3.
Figure 5:
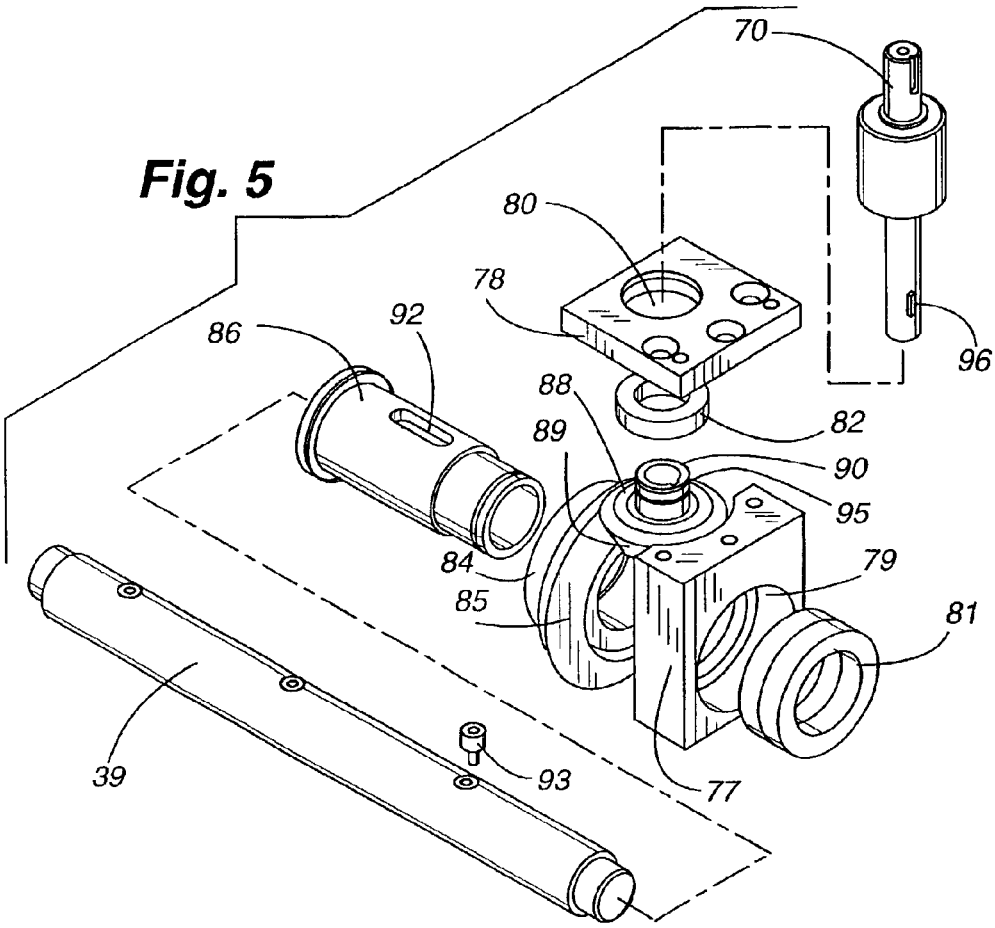
FIG. 5 is an exploded view of the transmission of FIG. 4.

Referring to FIGS. 4 and 5, the transmission 60 has a body 73, a primary gear 74 and a secondary gear 75. The body 73 has a generally rectangular first body plate 77 and a generally rectangular second body plate 78 rigidly attached to and extending transverse to the first body plate 77. A first plate aperture 79 extends through the first body plate 77 and a primary gear bearing 81 is pressed into the first plate aperture 79. A second plate aperture 80 extends through the second body plate 78 and a secondary gear bearing 82 is pressed into the second plate aperture 80.

The primary gear 74 has a beveled primary gear head 84 with a plurality of primary gear teeth 85, and an elongated, hollow, cylindrical primary gear sleeve 86 extending through the primary gear head 84. The primary gear sleeve 86 is sized to receive a lower primary shaft 39, and is pressed into the primary gear bearing 81 to rotably mount the primary gear 74 in the first body plate 77. The secondary gear 75 has a beveled secondary gear head 88 with a plurality of secondary gear teeth 89, and a hollow, cylindrical secondary gear sleeve 90 extending through the primary gear head 88. The secondary gear sleeve 90 is sized to receive a secondary shaft 70, and is pressed into the secondary gear bearing 82 to rotably mount the secondary gear 75, in meshed relationship to the primary gear 74, in the second body plate 78.

In the illustrated embodiment, the primary gear sleeve 86 is located on the lower primary shaft 39 having a drive roller 50 that is nearest to the entry end 19 and the secondary gear sleeve 90 is located on the secondary shaft 70 that is nearest to the entry end 19. A pin 93 is fixed in the lower primary shaft 39 and extends into a slotted primary gear aperture 92 in the primary gear sleeve 90, so that the primary gear 74 rotates with the lower primary shaft 39 and the primary gear 74 can move laterally on the lower primary shaft 39. A secondary gear keyway 95 extends along the secondary gear sleeve 90 and a key 96 fixed in the secondary shaft 70 engages the secondary gear keyway 95 such that the secondary gear 75 powers the secondary shaft 70 while allowing the secondary shaft 70 to move up and down relative to the secondary gear 75.

As shown in FIG. 3, a support plate 98 is rigidly mounted on the third side plate 48 near the discharge end 21, under the lower plate 64. Subframe 58 is supported by adjustment bolts 99 that extend vertically through the lower plate 64 and onto the second body plate 78 and onto the support plate 98. Turning the adjustment bolts 99 adjusts the subframe 58 up and down, and adjusts the angle of the subframe 58 relative to horizontal.

Spaced first and second adjustment plates 101 and 102 are rigidly mounted vertically on third side plate 48, at opposite ends of the lower plate 64 of the subframe 58. Adjustment bolts 99 extend through the first and second adjustment plates 101 to the lower plate 64, to provide adjustment of the subframe 58 laterally, and angular adjustment relative to the direction of travel of material 18 through apparatus 10.

The first and second secondary rollers 68 and 69 provide powered forming along a secondary pass line PL2. In the illustrated embodiment, the secondary pass line PL2 is a generally vertical surface that extends in the direction that the material 18 moves through apparatus 10, and up and down parallel to and intermediate the first and second secondary rollers 68 and 69. The transmission 60 allows adjustment in translation of the secondary powered section and thereby the secondary pass line PL2, relative to the to the primary pass line PL1, in two directions and rotational adjustment of the secondary powered section and thereby the secondary pass line PL2, relative to the to the primary pass line PL1, in two directions. Moving the primary gear 74 along the lower primary shaft 39 translates the secondary pass line PL2 laterally. Moving the subframe 58 up and down relative to the transmission 60, with the secondary shaft 70 sliding up and down in the secondary gear 75, translates the secondary pass line PL2 up and down. The axis of the lower primary shaft 39 forms a first axis A1 of rotation and rotating the transmission 60 and subframe 58 about the lower primary shaft 39 rotates the secondary pass line PL2 in a vertical plane. The axis of the secondary shaft 70 forms a second axis A2 of rotation and rotating the subframe 58 about the secondary shaft 70 rotates the secondary pass line PL2 in a horizontal plane.

The angle between the first and second body plates 77 and 78, and the angles of the primary and secondary gears 74 and 75, define the angle between the primary and secondary pass lines PL1 and PL2. In the illustrated embodiment, the angle between the primary and secondary pass lines PL1 and PL2 is 90 degrees. Any angle can be provided between the primary and secondary pass lines PL1 and PL2 by appropriate selection of the angle between the first and second body plates 77 and 78, and the angles of the primary and secondary gears 74 and 75. The primary gear 74 can be mounted on and driven by either a lower or an upper primary shaft 39 or 46.

Figure 6:
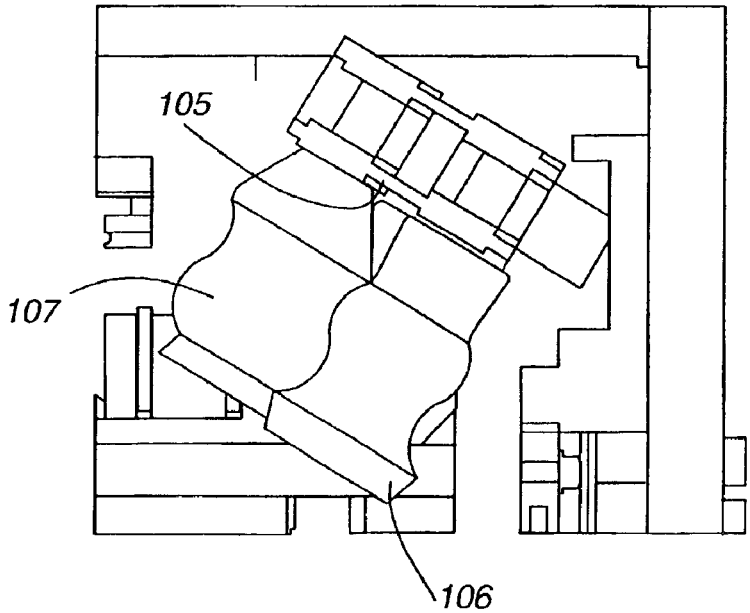
FIG. 6 is a partial sectional view taken along line 6—6 of FIG. 1.
Figure 7:
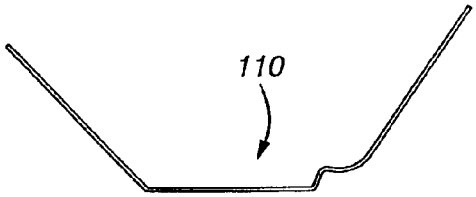
FIG. 7 is an end view of a rain gutter after forming by the primary powered section of the apparatus of FIG. 1.
Figure 8:
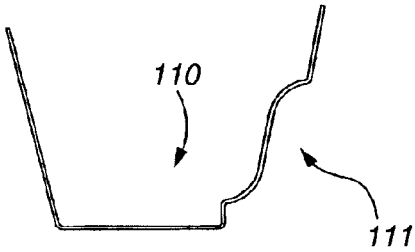
FIG. 8 is an end view of a rain gutter after forming by the intermediate section of the apparatus of FIG. 1.
Figure 9:
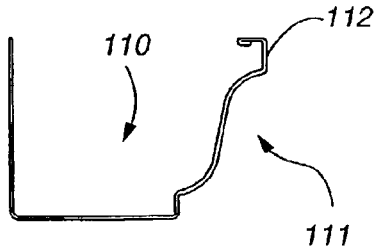
FIG. 9 is an end view of a rain gutter after forming by the secondary powered section of the apparatus of FIG. 1.

Referring to FIGS. 1 and 6, an intermediate section 104 is located intermediate the primary and secondary powered sections 14 and 15, and includes spaced idled roll forming intermediate stations 105, each having a diagonally extending first and second intermediate roller 106 and 107. Apparatus 10 includes a cutter 108 mounted at the discharge end 21, to cut the gutter 20 to selected lengths. In the illustrated embodiment, the primary powered section 14 includes three primary stations 32 that form the trough 110, shown in FIG. 7, of the gutter 20. The intermediate section 104 includes two roll forming intermediate stations 105 that form the face 111, shown in FIG. 8, of gutter 20. The secondary powered section 15 includes eight secondary stations 59, and forms the box 112, shown in FIG. 9, of gutter 20.

The method of the present invention generally includes roll forming shaped members from an elongated strip of malleable sheet material with powered sections each having a separate pass line. Specifically, the method includes a first step of providing the roll forming primary powered section 14 having the primary pass line PL1. The next step is forming the material 18 at the primary pass line PL1 with the primary powered section 14. The next step is providing the roll forming secondary powered section 15, coupled to and powered by the primary powered section 14, and having a secondary pass line PL2, separate from the primary pass line Pl1. The next step is forming the material 18 at the secondary pass line PL2 with the secondary powered section 15. The secondary pass line PL2 is adjustable in two directions in translation and two directions in rotation relative to the primary pass line PL1.

By providing the secondary powered section 15 with the secondary pass line PL2, the drag created by idled off pass line forming is reduced. The design of the forming rollers is simplified since the majority of the forming does not need to be at the primary pass line. Forming rollers can be designed to form in logical sections. Simpler rollers mean reduced fabrication costs. The adjustability of the secondary pass line PL2 relative to the primary pass line PL1 allows elimination of warp and residual stresses in the form members that can be caused by variations in operating conditions, input material and roller fabrication.

Although the present invention has been described with a certain degree of particularity, it is understood that the present disclosure has been made by way of example and that changes in details of structure may be made without departing from the spirit thereof.

What is claimed is:

1. Apparatus for roll forming shaped members from an elongated strip of malleable sheet material comprising:

a roll forming primary powered section through which a sheet material is passed to change the cross section of said material to a first shape, said primary powered section having a primary pass line along which said material is passed, said primary pass line being defined as the path said material passes without being formed, and a roll forming secondary powered section through which a sheet material is passed to change the cross section of the material to a second shape, said secondary powered section coupled to and powered by said primary powered section, said secondary powered section having a secondary pass line along which said material passed, said secondary pass line being defined as the path said material passes without being formed, said secondary pass line being separate and different from said primary pass line.

2. Apparatus as set forth in claim 1 wherein said secondary pass line is adjustable in rotation about a first axis lateral to said primary pass line and about a second axis transverse to said primary pass line.

3. Apparatus as set forth in claim 2 wherein said secondary pass line is adjustable in rotation about a first axis lateral to said primary pass line and about a second axis transverse to said primary pass line.

4. Apparatus as set forth in claim 1 wherein:

said primary powered section includes a powered primary shaft, and said secondary powered section includes a transmission coupled to said primary shaft to power said secondary powered section.

5. Apparatus as set forth in claim 4 wherein:

said secondary powered section includes a powered secondary shaft, and said transmission includes a body, a bevel first and second gears each rotably mounted in said body, said first and second gears being held in a constant meshed relationship by said body, said first gear being adjustably mounted on said primary shaft and said secondary shaft being adjustably mounted on said second gear.

6. Apparatus as set forth in claim 5 wherein:

said secondary powered section includes a subframe adjustably mounted on said transmission and having said secondary shaft rotably mounted therein, said subframe having at least one roll forming secondary station powered by said secondary shaft with said second pass line passing through said secondary station, and said subframe is laterally adjustable by translation of said first gear along said primary shaft, said subframe is transversely adjustable by translation of said subframe towards and away from said transmission, said subframe is rotationally adjustable by rotation of said subframe and said transmission about said primary shaft and by rotation of said subframe about said secondary shaft.

7. Apparatus as set forth in claim 1 wherein said secondary pass line is transverse to said primary pass line.

8. Apparatus for roll forming shaped members from an elongated strip of malleable sheet material comprising:

a roll forming primary powered section having a powered primary shaft and a primary pass line, and a roll forming secondary powered section having a secondary pass line transverse to said primary pass line, said secondary powered section including a transmission, a secondary shaft and a subframe, said transmission including a body, a bevel first and second gears each rotably mounted in said body, said first and second gears being held in a constant meshed relationship by said body, said first gear being adjustably mounted on said primary shaft and said secondary shaft being adjustably mounted on said second gear, said subframe being adjustably mounted on said transmission and said secondary shaft being rotably mounted in said subframe, said subframe having at least one roll forming secondary station powered by said secondary shaft with said second pass line passing through said second secondary station, said subframe being laterally adjustable by translation of said first gear along said primary shaft, said subframe being transversely adjustable by translation of said subframe towards and away from said transmission, said subframe being rotationally adjustable by rotation of said subframe and said transmission about said primary shaft and by rotation of said subframe about said secondary shaft, whereby said second pass line is adjustable in translation laterally and transversely relative to said first pass line, and said second pass line is adjustable in rotation about an axis transverse to said primary pass line and about an axis lateral to said primary pass line.

9. A roll forming secondary powered section, for apparatus for roll forming shaped members from an elongated strip of malleable sheet material with said apparatus having a primary roll forming powered section through which a sheet material is passed to change the cross section of said material to a first shape, said primary roll forming powered section with a primary pass line along which said material is passed, said primary pass line being defined as the path said material passes without being formed and at least one powered primary shaft parallel to said primary pass line and normal to the direction of travel of said material through said apparatus, comprising:

a transmission on and powered by said primary shaft, and a secondary roll forming station through which said sheet material is passed to change the cross section of said material to a second shape, said secondary roll forming station defining a secondary pass line along which said material is passed, said secondary pass line being defined as the path said material passes without being formed, said secondary pass line being separate and different from said primary pass line, said secondary roll forming station including a secondary shaft coupled to and powered by said transmission.

10. The secondary powered section as set forth in claim 9 wherein said secondary roll forming station, and thereby said secondary pass line, is adjustable relative said primary pass line in translation parallel to said primary shaft and in translation transverse to said primary pass line.

11. The secondary powered section as set forth in claim 9 wherein said secondary roll forming station, and thereby said secondary pass line, is adjustable relative said primary pass line in rotation about said primary shaft, and in rotation about said secondary shaft.

12. The secondary powered section as set forth in claim 9 wherein said transmission includes a body, and bevel first and second gears each rotably mounted in said body, said first and second gears being held in a constant meshed relationship by said body, said first gear being adjustably mounted on said primary shaft and said secondary shaft being adjustably mounted on said second gear.

13. The secondary powered section as set forth in claim 12 further comprising a subframe adjustably mounted on said transmission, said roll forming secondary station being mounted in said subframe and said secondary shaft being rotably mounted in said subframe, and said subframe being adjustable by translation of said first gear along said primary shaft, said subframe being adjustable by translation of said subframe towards and away from said transmission, said subframe being rotationally adjustable by rotation of said subframe and said transmission about said primary shaft, and by rotation of said subframe about said secondary shaft.

14. The secondary powered section as set forth in claim 9 wherein said secondary pass line is transverse to said primary pass line.

15. A roll forming secondary powered section, for apparatus for roll forming shaped members from an elongated strip of malleable sheet material with said apparatus having a primary roll forming powered section with a primary pass line and at least one powered primary shaft parallel to said primary pass line and normal to the direction of travel of said material through said apparatus, comprising:

a transmission having a body, a bevel first and second gears each rotably mounted in said body, said first and second gears being held in a constant meshed relationship by said body, said first gear being adjustably mounted on said primary shaft, and a subframe adjustably mounted on said transmission, said subframe including a secondary roll forming station mounted therein and a secondary shaft being rotably mounted therein, said secondary roll forming station defining a secondary pass line transverse to said primary pass line, said secondary shaft being adjustably mounted on and powered by said second gear, said subframe being adjustably by translation of said first gear along said primary shaft, said subframe being adjustable by translation of said subframe towards and away from said transmission, said subframe is rotationally adjustable by rotation of said subframe and said transmission about said primary shaft and by rotation of said subframe about said secondary shaft.

16. A method of roll forming shaped members from an elongated strip of malleable sheet material comprising the steps of:

providing a roll forming primary powered section through which a sheet material is passed to change the cross section of said material to a first shape, said primary powered section having a primary pass line along which said material is passed said primary pass line being defined as the path said material passes without being formed, providing a roll forming secondary powered section through which said sheet material is passed to change the cross section of said material to a second shape, said secondary powered section having a secondary pass line along which said material is passed, said secondary pass line being defined as the path said material passes without being formed, said secondary pass line being separate and different from said primary pass line, roll forming said material along said primary pass line with said primary powered section, and then roll forming said material along said secondary pass line with said secondary powered section.

17. The method as set forth in claim 16 wherein:

said step of roll forming said material along said first pass line roll forms a first shape in said material, and said step of roll forming said material along said secondary pass line roll forms a second shape in said material.

18. The method as set forth in claim 16 wherein said secondary powered section is coupled to and powered by said primary powered section.

19. The method as set forth in claim 16 wherein said secondary powered section, and thereby said secondary pass line is adjustable in translation laterally and transversely relative to said primary pass line.

20. The method as set forth in claim 16 wherein said secondary powered section, and thereby said secondary pass line, is adjustable in rotation about a first axis lateral to said primary pass line and in rotation about a second axis that is transverse to said primary pass line.

21. A method of roll forming shaped members from an elongate strip of malleable sheet material comprising the steps of:

providing a roll forming primary powered section through which a sheet material is passed to change the cross section of said material to a first shape, said roll forming primary powered section having a primary pass line along which said material is passed, said primary pass line being defined as the path said material passes without being formed, providing a roll forming secondary powered section through which said sheet material is passed to change the cross section of said material to a second shape, said roll forming secondary powered section having a secondary pass line along which said material is passed, said secondary pass line being defined as the path said material passes without being formed, said secondary pass line being separate and different from said primary pass line, said secondary powered section being coupled to and powered by said primary powered section, said secondary powered section, and thereby said secondary pass line being adjustable in translation laterally and transversely relative to said primary pass line, and said secondary powered section, and thereby said secondary pass line, being adjustable in rotation about a first axis lateral to said primary pass line and in rotation about a second axis that is transverse to said primary pass line, roll forming a first shape said material along said primary pass line with said primary powered section, and then roll forming a second shape said material along said secondary pass line with said secondary powered section.

* * * * *